US007174742B2

(12) United States Patent
Thomas et al.

(10) Patent No.: US 7,174,742 B2
(45) Date of Patent: Feb. 13, 2007

(54) COMBINED METHOD AND APPARATUS FOR RECOVERING AND RECLAIMING REFRIGERANT, SOLVENT FLUSHING, AND REFRIGERANT RECHARGING

(75) Inventors: Raymond H. Thomas, Pendleton, NY (US); Kane D. Cook, Eggertsville, NY (US); Guillermo J. Hitters, Hamburg, NJ (US); Gary M. Knopeck, Lakeview, NY (US); Raymond Chia, Singapore (SG)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/174,945

(22) Filed: Jul. 5, 2005

(65) Prior Publication Data

US 2007/0006609 A1 Jan. 11, 2007

(51) Int. Cl.
*F25B 43/04* (2006.01)

(52) U.S. Cl. ..... 62/475; 62/77; 62/149

(58) Field of Classification Search ..... 62/303, 62/475, 149, 77; 134/10, 22.2
See application file for complete search history.

(56) References Cited

U.S. PATENT DOCUMENTS 4,313,311 A * 2/1982 McCord ..... 62/197
4,537,660 A * 8/1985 McCord ..... 202/170
5,172,562 A 12/1992 Manz et al.
5,182,918 A 2/1993 Manz et al.
5,209,077 A 5/1993 Manz et al.
6,134,899 A 10/2000 Brown et al.
6,138,462 A 10/2000 Murray et al.
6,247,325 B1 6/2001 Muston et al.
2004/0231702 A1 11/2004 Thomas et al.

* cited by examiner

*Primary Examiner*—Melvin Jones
(74) *Attorney, Agent, or Firm*—Erika S. Wilson

(57) ABSTRACT

A method and apparatus (10) for servicing refrigeration system (12) which provides a single device for recovering and reclaiming refrigerant, flushing the refrigerant system with solvent, and recharging the system with refrigerant. Refrigerant is recovered and reclaimed by withdrawing the refrigerant from the refrigeration system, vaporizing the refrigerant, removing the contamination from the refrigerant, liquefying the refrigerant, and then storing the cleaned refrigerant. The refrigeration system, or a component of it, can then be cleaned with solvent, using the same apparatus used to flush the refrigeration system with solvent. After flushing, the solvent is processed by vaporizing the solvent, removing the contamination from the solvent, liquefying the solvent, and then storing the cleaned solvent.

20 Claims, 1 Drawing Sheet

COMBINED METHOD AND APPARATUS FOR RECOVERING AND RECLAIMING REFRIGERANT, SOLVENT FLUSHING, AND REFRIGERANT RECHARGING

FIELD OF THE INVENTION

The present application relates to methods and apparatus for servicing refrigeration systems, and more particularly to methods and apparatus providing a single device for recovering and reclaiming refrigerant, flushing the refrigerant system with solvent, and recharging the system with refrigerant.

BACKGROUND OF THE INVENTION

In the air-conditioning and refrigeration industry, there is a need for machines that recover, clean and recharge refrigerants from old systems or systems that have malfunctioned. At the same time, the industry also requires air-conditioning and refrigeration system cleaning equipment for systems that are being retrofitted and or have malfunctioned due to internal contamination. At present, such equipment exists separately making it necessary for a technician to set up and use one machine for one process and then separately connect and use a second machine to run the second process. For example, where solvent flushing is desired, three different connections are required, e.g., first the refrigerant recovery and reclamation machine is set up and operated, then the refrigerant recovery reclamation machine is disconnected and a solvent flushing machine connected and operated, and finally, the flushing machine is disconnected and then the refrigerant recovery reclamation machine is reconnected to recharge the system with refrigerant.

The refrigerant recovery, reclamation and recharging device evacuates the refrigerant from the refrigeration system and can clean or purify the evacuated refrigerant before storing the cleaned refrigerant for reuse. Such machines can also recharge a refrigeration system with cleaned refrigerant removed from the system and add new refrigerant as necessary to make up for any lost refrigerant. Examples of such devices are known in the art and are shown in U.S. Pat. Nos. 5,172,562, and 6,134,899 and 6,247,325, which patents are hereby incorporated by reference herein. Some of these devices can also flush the refrigerant system with the refrigerant, but are not capable of flushing with solvent.

Separate solvent flushing devices are also known in the art. Such devices are capable of flushing solvent through components of the refrigeration system to remove oils, particulates and other contamination that may have a detrimental effect on the refrigeration system. This cleaning is particularly desirable after a system failure such as a catastrophic compressor failure. Such systems can purify and clean the used solvent so that the solvent can be reused. An example of such a device is illustrated in US patent publication 20040231702 which document is hereby incorporated by reference herein.

The ability to perform maintenance on a refrigeration system can be improved by providing a single device or apparatus that can recover, reclaim and recharge refrigerant as well as solvent flush the system. This would avoid the need to connect two different machines and would result in a shorter cycle time for the technician in utilizing the equipment.

SUMMARY OF THE INVENTION

The present invention provides a method and apparatus for recovery and reclamation of refrigerant from a refrigeration system, and solvent flushing of at least a component of the refrigeration system. These functions are carried out by a single apparatus. The method includes recovering used refrigerant from the system by carrying out at least the following steps: withdrawing the used refrigerant from the refrigeration system; vaporizing the withdrawn refrigerant with an evaporator; removing contamination from the vaporized refrigerant to clean said refrigerant; liquefying said cleaned refrigerant; and storing the liquefied clean refrigerant. The method also includes cleaning at least one component of the refrigerant system by carrying out at least the following steps: flushing solvent through the component to remove contamination from the component, the solvent being of a different composition than the refrigerant; withdrawing the flushed solvent from the refrigeration system; vaporizing the withdrawn solvent with the evaporator; removing contamination from the vaporized solvent to clean the solvent; liquefying the cleaned solvent; and then storing said liquefied cleaned solvent. An apparatus for carrying out these functions with a single device is also provided.

BRIEF DESCRIPTION OF THE DRAWING

The foregoing summary and the following detailed description may be better understood when read in conjunction with the accompanying drawing. For the purposes of illustrating the invention, a preferred embodiment is shown in the drawing. It is understood, however, that this invention is not limited to the precise arrangements shown.

DETAILED DESCRIPTION

Figure 1:
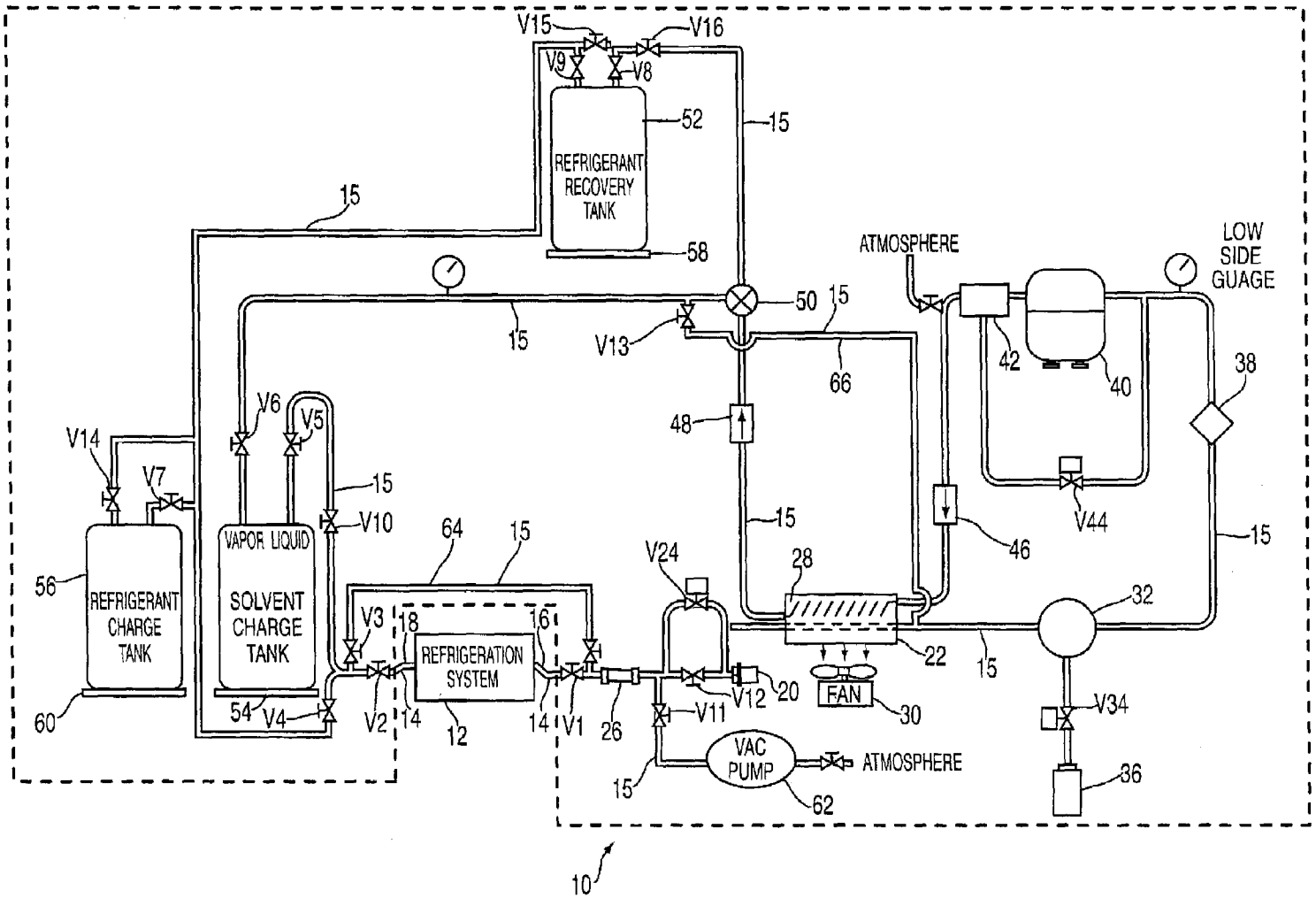
FIG. 1 is a schematic diagram of an apparatus for refrigerant recovery and reclamation, solvent cleaning, and refrigerant recharge for use with refrigeration systems.

The present invention provides a novel method and device for servicing refrigeration systems. As used herein, reference to refrigeration systems refers to any type of refrigeration system such as automotive air conditioners, residential and commercial air conditioners, refrigeration equipment, and other similar type equipment.

With reference to FIG. 1, one form of the invention is illustrated and now described. The apparatus 10 is a single device that is capable of recovering refrigerant from a refrigeration system 12, reclaiming the refrigerant, i.e., cleaning the recovered refrigerant so that the refrigerant can be reused, flushing the refrigerant system 12 with solvent to clean the refrigerant system of oils and other contamination, and finally, recharging the refrigerant system with clean refrigerant. Since the apparatus 10 handles both refrigerant and solvent using the same equipment, the apparatus 10 will initially be described with reference to "fluid" which is used herein generically for both refrigerant and solvent. Since the refrigerant and solvent processed by the apparatus 10 are cleaned and stored for reuse, the equipment must be suitable for use with both the refrigerants and solvents used. As will be discussed further below, refrigerants and solvents based on HFC (hydrofluorocarbon) chemistry are suitable although other compatible combinations of refrigerants and solvents are also believed suitable.

The apparatus 10 is shown within the dotted line, and the refrigeration system 12 to be serviced is shown outside the dotted line. The apparatus 10 is connected to the refrigerant system 12 by a connector 14 which can include any suitable fluid conduit means, typically flexible hoses or tubing with quick-disconnect couplings for connection to the refrigeration system 12. In the illustrated embodiment, one connection is on the low pressure side 16 and a second connection on the high pressure side 18 of the refrigerant system 12. Suitable fluid conduits 15, such as tubing and piping, are used to fluidly connect the equipment that forms the apparatus 10. The apparatus 10 also includes valves, pressure gauges and temperature gauges and other equipment as known through which the apparatus 10 can be controlled, preferably via a microprocessor based controller capable of operating the system electronically with solenoid controlled valves. Thus the valves shown in the drawing can be solenoid type valves regardless of how the valve is illustrated.

The fluid removed from the refrigerant system 12 into the apparatus 10, be it the refrigerant or solvent, depending on the cycle, is evaporated into a gaseous phase (or vapor) so that any oils, particulates and other contamination that does not evaporate can be removed. This is accomplished by passing the fluid removed from the refrigerant system 12 through an expansion valve 20, where the fluid begins to vaporize, and then an evaporator 22 to complete the vaporization process. A bypass valve V24, allows the expansion valve 20 to be bypassed as further described below. A strainer 26 positioned prior to the expansion valve 20 is preferred for removing particulates.

The evaporator 22 can be a combined unit having coils for both the evaporator 22 and condenser 28, thereby allowing heat transfer between the evaporator and condenser. A fan 30 blows air across the condenser 28 to the evaporator 22 to enhance the heat exchange between the two as is known in the art. Any suitable arrangement of heat exchangers can be used.

The cold vapor fluid flows from the evaporator 22 to a helical oil separator 32 which separates from the vapor any oil droplets and debris (any contamination that has not evaporated). Any suitable type of separator may be used as is known in the art. The oil separator has an oil drain valve V34, preferably solenoid operated, for connection with a disconnectable drain bottle 36 for collecting and removing the contamination, the operation of which is described below.

The fluid vapor flows next through a filter/dryer 38 were any droplets of water and particulates remaining are removed. Any suitable filter/dryer may be used. The filter/dryer 38 may also have the capability of removing acid from the fluid vapor.

The fluid vapor next flows to a compressor 40 which compresses the vapor to a hot vapor. As the hot compressed vapor exits the compressor 40, it may take with it some of the compressor's lubricating oil. An oil separator 42, located downstream of the compressor 40, removes any such oil from the hot vapor and returns it to the compressor 40 through an oil return solenoid valve V44 which may be operated cyclically, intermittently, or in any manner as known in the art.

The hot vapor from the compressor 40 then passes through a check valve 46 to the fan cooled condenser 28 where it is condensed into a hot liquid phase. The hot liquid then flows through a check valve 48 to a storage tank via a three-way valve 50. The solenoid controlled three-way valve 50 is used to direct the fluid to the appropriate tank. For example, if the fluid being processed by the apparatus 10 is refrigerant removed from the refrigeration system 12, then the refrigerant is directed to a refrigerant recovery tank 52. On the other hand, if the fluid being processed is solvent, the solvent fluid is directed to the solvent tank 54.

A refrigerant make-up tank 56 is provided from which clean make-up refrigerant can be charged into the refrigeration system 12 for recharging. Scales 58 and 60 can be provided to monitor the weight of the refrigerant tanks 52 and 56 so that the amount of refrigerant being collected or dispensed can be determined.

Having described the basic components of the apparatus 10, a description of the various process methods (cycles) carried out by the apparatus 10 is now described. The first cycle typically carried out in the service of a refrigeration system is to recover and reclaim the refrigerant from the refrigeration system 12. Fluid connector conduits 14, such as flexible hoses with quick disconnects, connect the apparatus 10 to the refrigerant system 12. To increase the speed of the removal of the refrigerant, hoses can be connected to both the high and low pressure sides 16, 18 of the refrigeration 12 system and coupled together through fluid conduit 64 as illustrated in the drawing, although any known connection means can be used. For example, it may be possible in certain systems 12 to withdraw the refrigerant from only one of the high and low pressure sides. Thus, with the valves V4 and V10 to the refrigerant and solvent tanks closed, and the valves V1, V2, V3, and V8 (on the refrigeration recovery tank 52) opened, the refrigerant is drawn from the high and low sides 16, 18 of the refrigeration system 12 through the strainer 26. The refrigerant then continues through the expansion valve 20 to the evaporator 22 where the liquid refrigerant evaporates into the gaseous phase. The refrigerant continues through the oil separator 32 where any contamination that has not vaporized, e.g., oil and particulates, are separated from the refrigerant. The refrigerant continues through the filter/dryer 38, removing any remaining moisture and particulates, and into the compressor 40 where the refrigerant vapor is compressed. The compressed vapor then flows through the check valve 46 to the fan cooled condenser 28 where it is condensed into a liquid phase, the fan 30 blowing air from the condenser 28 to the evaporator 22 to aid in the heat transfer between the two. The liquid refrigerant continues through the check valve 48 through the three-way valve 50 which has been operated to direct the refrigerant into the refrigeration recovery tank 52.

As can be appreciated, this recovery and reclamation cycle removes and cleans the refrigerant prior to sending it through the open valve V8 for storing it in the refrigeration recovery tank 52. Particulates and other contamination that do not evaporate are removed by the helical oil separator 32, and any remaining droplets of water and particulars are removed at the filter dryer 38. This recovery and reclamation cycle continues until low pressure readings in the refrigeration system indicate that all refrigerant has been removed. Toward the end of the refrigerant recovery and reclamation cycle, the recovery process may be sped up by bypassing the expansion valve 20 by opening the solenoid bypass valve V24. This makes it easier to evaporate and remove any small amounts of remaining refrigerant in the refrigeration system 12. Once all refrigerant has been recovered, the compressor 40 can be shut down and the valve V8 close. The apparatus 10 includes suitable pressure gauges and transducers for monitoring the pressure within. The recovery and reclamation cycle described above is similar to that of existing recovery/reclamation cycles described and U.S. Pat. Nos. 6,247,325 and 6,138,462, both of which are hereby incorporated herein by reference.

Once the refrigerant recovery and reclamation cycle is completed, the flushing cycle using solvent can begin. At least three possible modes of solvent flushing are contemplated. The first mode is a full refrigeration system 12 flush whereby the apparatus 10 remains connected to the refrigeration system 12 on both the high and low pressure sides 16, 18 as illustrated in FIG. 1. It is appreciated that the full system flush bypasses the compressor of the refrigeration system 12 as the liquid solvent will not flow through the idled compressor. For this flushing mode, valves V3 and V4 are closed, valves V1, V2, V5 and V10 are opened and the three-way valve 50 is operated to direct fluid flow coming up from the check valve 48 to the conduit 15 going through the valve V6 into the solvent tank 54. The compressor 40 is then turned on which will help pull a vacuum on the refrigeration system 12 while at the same time increasing the pressure in the solvent tank 54 to force the solvent from the tank 54 through valve V5 into the refrigeration system 12. It may be desirable on initiation of the flushing cycle to keep the valve V2 closed for a short period of time to allow the pressure to buildup in the solvent tank 54 so that upon opening the valve V2 a surge of solvent is delivered to the refrigeration system 12.

The solvent from the liquid outlet of the tank 54 (there being a dip tube there in) flows to the refrigeration system 12 through valve V2. The refrigeration system 12 is connected preferably to the apparatus 10 to be flushed with the solvent flowing opposite the normal flow of refrigerant through the refrigeration system 12 in normal use. Thus, the connections to the refrigeration system could be reversed. Thus the solvent, in liquid form, passes through the refrigeration system 12 where it picks up the contamination, i.e., oil laden with waxes, dirt, fines and other debris caused by both normal wear and catastrophic failure of the refrigeration system 12.

The solvent exiting the refrigeration system 12 is then evaporated into a gaseous phase by passing the solvent laden with the contaminants from the refrigeration system 12 through the expansion valve 20, where the solvent begins to vaporize, and then through the evaporator 22 to complete the vaporization process. The gaseous solvent continues through the oil separator 32 where, as described above with relation to the refrigerant reclamation cycle, any contamination that has not vaporized is separated from the solvent. The solvent then continues through the filter/dryer 38, removing any remaining moisture and particulates, and into the compressor 40 where the gaseous solvent is compressed. The solvent vapor then passes through the check valve 46 to the fan cooled condenser 28 where it is condensed into a liquid phase solvent. The liquid solvent continues through the check valve 48 through the three-way valve 50 which is operated to direct the solvent into the vapor inlet of the solvent tank 54 from which the solvent is reused for further flushing.

Once the refrigeration system 12 has been sufficiently cleaned, the solvent is recovered. For this the valve V5 of V10 on the outlet side of the tank is closed to isolate the solvent source from the refrigeration system 12, and the compressor 40 is run to remove all solvent from the refrigeration system 12. Transparent sections of the fluid conduits 15 allow an operator of the apparatus 10 to visually see when the solvent has stopped flowing, indicating that the solvent was completely removed from the refrigeration system 12. Toward the end of the solvent recovery cycle, the recovery process can be sped up by bypassing the expansion valve 20 by opening the solenoid bypass valve 24. This makes it easier to evaporate and remove any small amounts of remaining solvent in the component 14. Once all solvent has been recovered, the compressor 40 can be shut off.

A second mode of flushing is similar to that described above with the exception that the expansion valve (which can comprise a capillary tube) of the refrigeration system 12 is bypassed with a shunt or other similar device to allow a higher solvent flow rate through the refrigeration system 12 during the flushing cycle. Otherwise, the connections and the method of operation are the same.

A third mode of flushing involves flushing only specific components of the refrigeration system 12. For example, if it is desired to flush only the evaporator of the refrigeration system 12, then the hoses 14 would be reconnected so that solvent is flushed across only the evaporator. Again, this mode operates similar to that described above with the exception that the hoses are reconnected for cleaning the particular component 12. The solvent flushing cycle is similar to that disclosed in US Patent publication 20040231702 which is hereby incorporated herein by reference.

The refrigerant charge cycle recharges the system 12 with clean refrigerant from the refrigerant recovery tank 52. Any additional refrigerant that may be needed for makeup can be drawn from the refrigerant charge tank 56. Before the refrigerant can be recharged, the refrigeration system 12 must be evacuated. The refrigeration system 12, if the solvent flushing cycle has just been completed, may be evacuated or at least partially evacuated. Additional evacuation may be required to ensure proper refrigerant charge. Otherwise, a full evacuation is required. The compressor 40 of the present invention may be of a type that can function both as a compressor and vacuum pump. Separate units can also be provided, e.g., a compressor 40 configured specifically for the recovery and flushing cycles, and a separate vacuum comp 62 for evacuating the system 12. Since the evacuation cycle removes any trace gases such as air, moisture or any other vapors from the system 12, the compressor 40 or vacuum pump 62 can be vented to the atmosphere during this cycle.

To begin the evacuation cycle, valves V4 and V10 are closed to isolate the solvent and refrigerant tanks, and valves V1, V2 and V3 are opened so that a vacuum can be pulled on the refrigeration system 12. If the compressor 40 is used to pull the vacuum, the solenoid bypass valve V24 can be opened to the pull a vacuum directly on the refrigeration system 12. The compressor 40 is exhausted to the atmosphere. If the vacuum pump 62 is used to pull the vacuum, valve V11 is opened, and the vacuum pump 62 is vented to the atmosphere. The evacuation continues to exhaust any trace gases until pressure readings in the refrigeration system 12 indicate that the refrigeration system 12 has been evacuated sufficiently for receiving refrigerant. Moreover, this ensures that any trace amounts of solvent left in the system is removed to prevent any solvent from remaining and mixing with the refrigerant charge, as there should be no solvent in the working refrigerant system 12. At this point the compressor, or vacuum pump, is shut off and the valves that isolate the apparatus 10 from the refrigeration system 12 closed.

Refrigerant from the refrigerant recovery tank 52 is initially used for recharging the refrigeration system 12. The flow path of the refrigerant is from the liquid takeoff valve V9 from the refrigerant recovery tank 52 which typically has a dip tube into the liquid within the tank. The refrigerant flows through the valve V9 through the conduit 15 through the open valves V4 and V2 into the refrigeration system 12. It is appreciated that the refrigerant flow can be directed to the valve V1 by closing the valve V2 and opening valve V3 should that be the side of the low pressure side desired for charging the refrigeration system while running the compressor of the refrigeration system 12. Should more refrigerant be required then is in the refrigerant recovery tank 52, makeup refrigerant can be drawn from the refrigerant charge tank 56. Weight scales 58 and 60 allow the apparatus to monitor the amount of refrigerant charged to the refrigeration system 12. Once the system is fully charged with refrigerant, the valves V1 and or V2 are closed at which point the hoses 14 can be disconnected from the refrigeration system 12 to isolate the apparatus 10. It is appreciated that liquid and or vapor refrigerant can be added to the system 12 in any means known in the art, refrigerant take offs for both vapor and liquid being provided with the refrigerant tanks 52 and 56, e.g., for tank 52, valve V8 connects to the vapor takeoff (also the liquid inlet), and valve V9 connects to the liquid take off (valves V15 and V16 are also operated as necessary to isolate and open the various sections of the apparatus 10). For refrigerant tank 56, valve V7 connects to the liquid takeoff and valve V14 to the vapor takeoff.

At some point the oil and other contamination removed from the refrigerant and solvent by the separator 32 is purged from the apparatus 10 and collected in the oil drain bottle 36. This can be done after one or several uses of the apparatus 10. As shown, a fluid conduit 66 connected through the valve V13 to the vapor in the solvent tank 54 is connected to the inlet side of the oil separator 32 (downstream of the evaporator 22). To purge the contamination, with the compressor 40 turned off, and the three way valve 50 closed, the valve V13 is opened to expose the helical oil separator 32 to the pressure of the solvent tank 54. With the opening of the oil drain solenoid valve 34, the pressure from the solvent source tank 12 forces the oil and contaminates previously removed and held in the oil separator 32 into the oil drain bottle 36 for disposal.

The combination of refrigerants and solvents should be chosen for the particular refrigerant system. For example, for use with refrigeration systems using hydrocarbon based lubricants such as mineral oil, alkyl benzenes, and poly-alpha-olefins, a solvent that includes chlorine may be preferred, e.g., trans-1,2-dichloroethene. Mixtures of trans-1,2-dichloroethene and HFC based solvents, such as HFC-245fa ($CF_3CH_2CHF_2$), HFC-43-10 ($CF_3$—CHF—$CF_2$—CHF—$CF_3$) or HFC-365mfc ($CF_3CH_2CF_2CH_3$) are preferred. Such mixtures are useful since they provide reduced flammability while preserving the ability of the chlorinated solvent to dissolve hydrocarbon based lubricants. Such lubricants are common with HCFC refrigerants such a R22. For refrigeration systems using lubricants based on carbon, hydrogen and oxygen, such as polyalkylene glycol, poly-alpha-esters, and polyvinyl ethers, a solvent that does not include chlorine is preferred, e.g., HFC-245fa, HFC-43-10 or HFC-365mfc. Such lubricants are common in HFC based refrigerants. Additionally, the various components of the apparatus 10 is to be compatible with the refrigerant and solvents used, i.e., both the refrigerant and solvent used will vaporize and liquefy as required in the various process steps, although it is preferred that the equipment be specified for optimal use with the refrigerant.

One group of refrigerants presently in use include HFC (hydrofluorocarbon) based refrigerants. These include HFC-134a (1,1,1,2-tetrafluoroethane), HFC-32 (difluoromethane), HFC-125, (pentafluoroethane), HFC-143a (1,1,1-trifluoroethane) and their mixtures. Additionally refrigerants such as carbon dioxide, butane, isobutane and propane are used. These materials are used as refrigerants either in their pure state or as mixtures with one another. Examples of their mixtures include R-404A (R125/143a/134a [44.052.0/4.0]) and R-410A (R-32/125[50.0/50.0]). These pure compounds and their mixtures that are used as refrigerants are listed in ANSI/ASHRAE Standard 34-2004. A preferred solvent for use with this class of refrigerants is HFC-245fa (1,1,1,3,3-pentafluoropropane), itself a hydrofluorocarbon, which has good compatibility with no adverse reactions with HFC refrigerants. Moreover, the two are close enough in properties and characteristics that they can use the same equipment of the apparatus 10, although it is preferred that the compressor and other equipment of the apparatus 10 be specified for optimal use with the refrigerant. Regarding refrigerants and solvents, solvents having a boiling point in the range of about 0° C. to about 90° C. are preferred, and refrigerants having a boiling point in the range of about −60° C. to about 17° C. are preferred. A more preferred range for the solvents are those having a boiling point in the range of about 10° C. to about 45° C., and a more preferred range for the refrigerants are those having a boiling point in the range of about −60° C. to about 0° C.

While it is understood that the valves shown in the FIG. 1 can be solenoid valves as known in the art (whether indicated as such or not), hand operated valves may also be used for a manual system. It is also understood that the various components of the apparatus are connected with fluid conduits, such as metal tubing and piping, with suitable valves and connectors as is known in the art, and that suitable valves are provided for venting non compressible gasses such as air that may collect in the apparatus 10.

Thus it is seen that this invention provides a single apparatus capable of providing the functions previously carried out by multiple devices. The apparatus 10 can be a portable unit on wheels, with the refrigerant and solvent tanks easily connectable to the portable unit, or a stationary unit.

Changes and modifications in the specifically described embodiment can be carried out without departing from the scope of the invention which is intended to be limited only by the scope of the appended claims. For example, additional valves, solenoid and hand operated, may be added as desired for isolating or opening various sections of the fluid conduits and components of the apparatus 10 as known in the art.

What is claimed is:

1. A method carried out by a single apparatus for recovery and reclamation of refrigerant from a refrigeration system, and solvent flushing of at least a component of the refrigeration system, the method comprising:

(a) recovering used refrigerant from the refrigeration system by carrying out at least the following steps:
  i. withdrawing the used refrigerant from the refrigeration system;
  ii. vaporizing the withdrawn refrigerant with an evaporator;
  iii. removing contamination from the vaporized refrigerant to clean said refrigerant;
  iv. liquefying said cleaned refrigerant;
  v. storing the liquefied clean refrigerant;

(b) cleaning at least one component of the refrigeration system by carrying out at least the following steps:
  i. flushing solvent through the component to remove contamination from the component, said solvent being of a different composition than said refrigerant;
  ii. withdrawing the flushed solvent from the refrigeration system;
  iii. vaporizing the withdrawn solvent with said evaporator;
  iv. removing contamination from the vaporized solvent to clean the solvent;
  v. liquefying said cleaned solvent; and
  vi. storing said liquefied cleaned solvent.

2. The method of claim 1 further comprising:

(c) charging said refrigeration system with clean refrigerant by carrying out at least the following steps:

i. evacuating the refrigeration system; and ii. adding clean refrigerant to the evacuated refrigeration system.

3. The method of claim 2 wherein step (a)(i) comprises withdrawing said used refrigerant from both a high and low pressure side of said refrigeration system.

4. The method of claim 1 wherein said solvent has a boiling point in the range of about 10° C. to about 45° C., and said refrigerant has a boiling point in the range of about −60° C. to about 0° C.

5. The method of claim 1 wherein said solvent and said refrigerant are chosen from a group of chemicals comprising hydrofluorocarbons.

6. The method of claim 5 wherein said solvent comprises HFC-245fa and said refrigerant comprises HFC-134a.

7. The method of claim 2 wherein the flushing of the component in step (b) comprises flushing the evaporator.

8. The method of claim 2 further comprising the step of purging the contamination removed in steps (a)(iii) and (b)(iv).

9. The method of claim 1 wherein said solvent has a boiling point in the range of about 0° C. to about 90° C., and said refrigerant has a boiling point in the range of about −60° C. to about 17° C.

10. The method of claim 1 wherein step (a)(iv) comprises compressing said cleaned refrigerant by use of a compressor and condensing said cleaned refrigerant by use of a condenser, and step (b)(v) comprises compressing said cleaned solvent by use of said compressor and condensing said cleaned solvent by use of said condenser.

11. A method carried out by a single apparatus for recovery and reclamation of refrigerant from a refrigeration system, flushing the refrigeration system with solvent, and recharging the system with the cleaned refrigerant, said method comprising:

a. recovering used refrigerant from the refrigeration system by carrying out at least the following steps:

i. withdrawing the used refrigerant from the refrigeration system;

ii. vaporizing the withdrawn refrigerant, said step being carried out with an evaporator;

iii. removing contamination from said vaporized refrigerant so as to clean said refrigerant;

iv. compressing said cleaned refrigerant by use of a compressor;

v. liquefying said cleaned refrigerant; said step being carried out with a condenser;

vi. storing the liquefied refrigerant;

b. cleaning at least one component of the refrigeration system by carrying out at least the following steps:

i. flushing solvent through the component to remove contamination therefrom, said solvent being of a different composition than said refrigerant;

ii. vaporizing the flushed solvent, said step being carried out with said evaporator;

iii. removing contamination from said vaporized solvent so as to clean said solvent;

iv. compressing said cleaned solvent, said step being carried out with said compressor;

v. condensing said cleaned solvent, said step being carried out with said condenser;

vi. storing said condensed solvent;

c. charging said refrigeration system with clean refrigerant by carrying out at least the following steps:

i. pulling a vacuum in the refrigeration system; and ii. adding clean refrigerant to the evacuated refrigeration system.

12. The method of claim 11 wherein said solvent and said refrigerant are chosen from a group of chemicals comprising hydrofluorocarbons.

13. The method of claim 12 wherein said solvent comprises HFC-245fa and said refrigerant comprises HFC-134a.

14. The method of claim 11 further comprising the step of purging the contamination removed in steps (a)(iii) and (b)(iii) by using pressure from a source of said solvent to forcibly purge the contamination.

15. The method of claim 11 wherein step (c)(i) is carried out by use of a vacuum pump.

16. A single apparatus for recovery and reclamation of refrigerant from a refrigeration system, flushing the refrigeration system with solvent, and recharging the system with the cleaned refrigerant, said apparatus comprising:

a connector for connecting said apparatus to said refrigeration system;

a refrigerant recovery tank for collecting reclaimed refrigerant and from which reclaimed refrigerant can be charged to the refrigerant system;

a solvent tank from which solvent is taken for flushing the refrigeration system and to which cleaned solvent is returned, said solvent stored in said tank being of a different composition than that of said refrigerant;

an expansion valve for receiving the refrigerant after it is removed from the refrigeration system and receiving the solvent after it is flushed through the component, said expansion valve being fluidly connectable to said component to receive the refrigerant and solvent there from;

an evaporator for vaporizing the refrigerant and solvent, said evaporator being connected to said expansion valve for receiving the refrigerant and solvent from said expansion valve;

a separator fluidly connected to said evaporator for removing contamination from said vaporized refrigerant and vaporized solvent;

a compressor fluidly connected to said separator for compressing said vaporized refrigerant and vaporized solvent; and a condenser fluidly connected to said compressor for condensing said refrigerant and solvent back to a liquid, said condenser being fluidly connectable to said refrigerant recovery tank and said solvent tank.

17. The apparatus of claim 16 further comprising a fluid conduit connecting said solvent tank to said separator so as to be capable of providing pressure from said solvent tank to said separator to purge said contamination from said separator.

18. The apparatus of claim 16 wherein said refrigerant and said solvent comprise a hydrofluorocarbon.

19. The apparatus of claim 16 further comprising a valve connected fluidly between said condenser, said solvent tank, and said refrigerant tank, said valve being operable to direct said cleaned refrigerant to said refrigerant tank, and said cleaned solvent to said solvent tank.

20. The apparatus of claim 16 further comprising a vacuum pump for evacuating said refrigeration system, said vacuum pump being fluidly connected to said connector for connecting said apparatus to said refrigeration system.

* * * * *